United States Patent [19]

Simon

[11] 4,199,125

[45] Apr. 22, 1980

[54] WATERPROOF BATHTUB READING STAND

[76] Inventor: Kirby Simon, 82 Edgehill Rd., New Haven, Conn. 06511

[21] Appl. No.: 846,935

[22] Filed: Oct. 31, 1977

[51] Int. Cl.[2] ..... A47B 97/04

[52] U.S. Cl. ..... 248/441 A; 248/441 C; 4/185 AB

[58] Field of Search ..... 248/441 A, 441 B, 441 C; 4/185 AB

[56] References Cited

U.S. PATENT DOCUMENTS

| | | | |
|---|---|---|---|
| 2,006,169 | 6/1935 | Harris-Jones | 248/460 X |
| 2,807,908 | 10/1957 | Lykes | 248/451 |
| 2,909,761 | 10/1959 | Rockola | 340/162 |
| 3,396,929 | 8/1968 | Brown | 248/460 X |
| 3,863,882 | 2/1975 | Hatcher | 248/441 A X |
| 3,950,793 | 4/1976 | Adams | 4/185 AB |

*Primary Examiner*—William H. Schultz

[57] ABSTRACT

A reading stand for use in the bathtub on which is mounted a transparent waterproof container that holds the reading material and which has clips that are used to turn the pages without wetting them.

3 Claims, 5 Drawing Figures

WATERPROOF BATHTUB READING STAND

BACKGROUND OF THE INVENTION

1. Field of the Invention

The present invention relates to the field of reading stands and particularly to reading stands for use in the bathtub.

2. Description of the Prior Art

Prior to my invention, persons desiring to read while bathing in a tub have had to hold the reading material in their hands or place it on a stand, in both cases causing the reading material to become wet, either as a result of splashing or as a result of contact between moist hands and the pages being turned.

SUMMARY OF THE INVENTION

The object of this invention is to permit the user to read while bathing in a tub without causing the reading material to become wet.

My invention attains its objectives through the use of a mechanism which supports the reading matter above the water and shields it from the water, and which permits the pages to be turned without direct contact between the reader's hand and the page.

BRIEF DESCRIPTION OF THE DRAWINGS

FIG. 3 represents the transparent container affixed to a supporting bar that is to be mounted to the bathtub.

FIG. 1 is a detail of a cross-sectional view of the stationary shield shown in FIG. 3.

FIG. 2 is a detail of two small bars that constitute a clamp attaching the invention to the bathtub.

FIG. 5 represents the invention with the page-turning clip assemblies attached to the reading material.

FIG. 4 consists of detailed views of a page-turning clip.

DESCRIPTION OF THE PREFERRED EMBODIMENT

Figure 1:
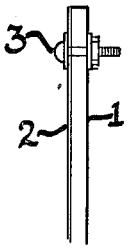
FIGS. 1, 2, and 3, considered together, represent the invention without the page-turning features.
Figure 2:
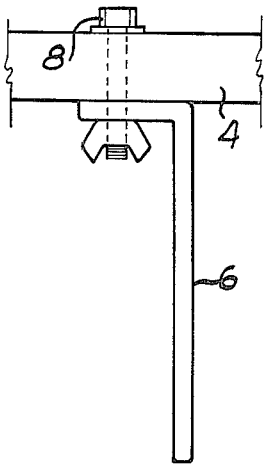
Figure 3:
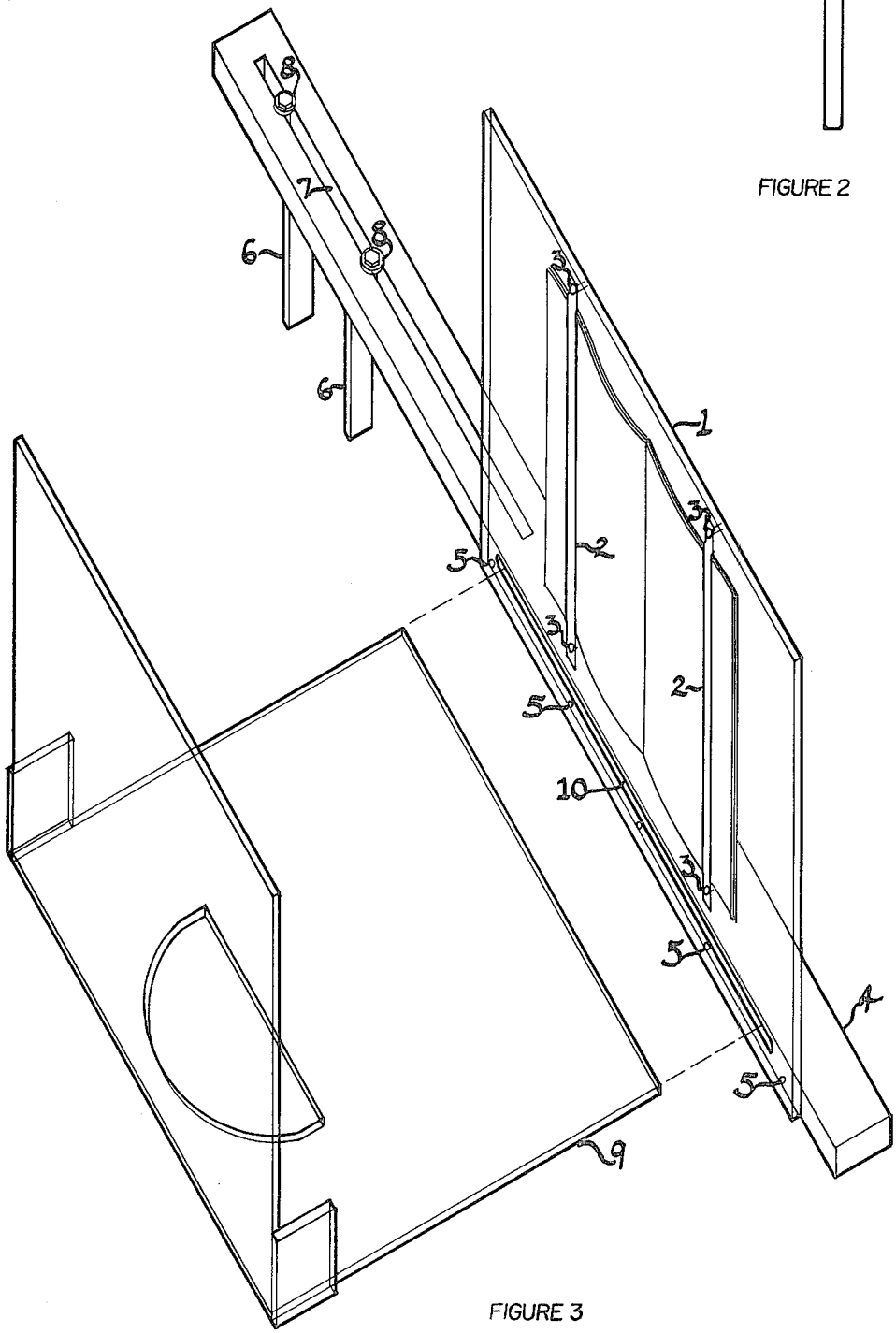

Referring to FIG. 3 of the drawing, the stationary shield 1 holds the reading material in place by elastic straps 2 secured to the shield 1 by screws 3. A bar 4 supports shield 1 and is attached to it by screws 5. The bar 4 rests on both sides of the tub and is secured to a side of the tube not adjacent to the wall (i.e., a free-standing side) by means of a clamp comprising two small bars 6. The clamp can be set along slot 7 by means of bolt-nut assemblies 8, so as to grip a free-standing side of the tub. A transparent moveable shield 9 slides through slot 10 in stationary shield 1.

Figure 4:
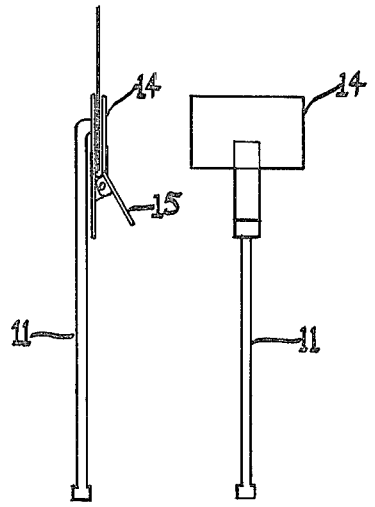
FIGS. 4 and 5, taken together, represent the invention including, and illustrating the operation of, its page-turning features.
Figure 5:
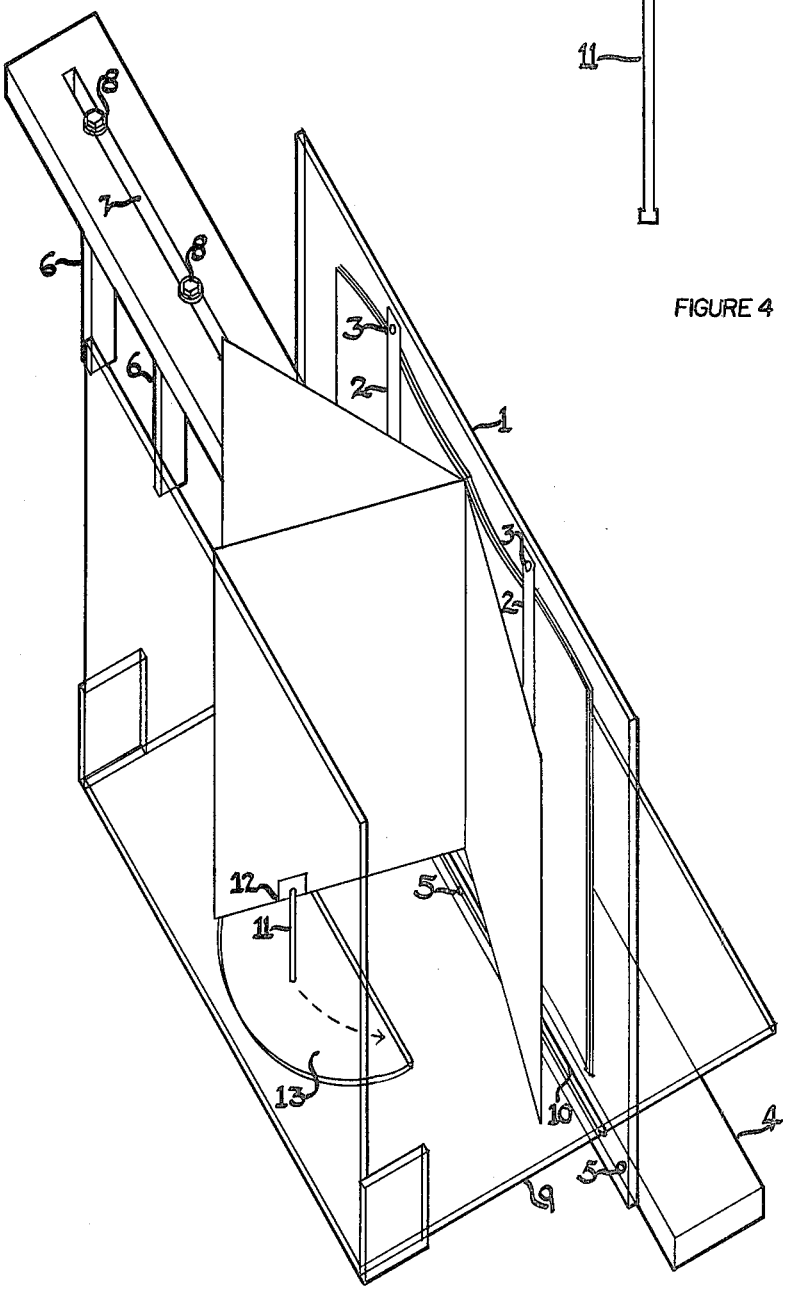

Referring to FIG. 5, a page-turning clip assembly 11 is attached to the reading material at point 12 and is used to turn the pages by being moved through aperture 13 in the transparent moveable shield 9. Referring to FIG. 4, the page-turning clip assembly 11 includes a clip 14 that is opened by means of tab 15 and closed by means of a spring.

OPERATION

The operation of my invention may be described as follows: The user affixes a page-turning clip assembly 11 to the bottom of each of the pages to be read while bathing, as shown in FIG. 5. The book is then slipped through the elastic straps 2 as shown in FIG. 5, leaving free of the straps the pages that are to be read. The moveable shield 9 is then inserted in slot 10 and pressed forward until it rests firmly against shield 1. Supporting bar 4 is then placed across the tub and fastened to a free-standing side of the tub by means of the clamp comprising two small bars 6; this is accomplished by adjusting the bars 6 to the width of the side of the tub and then tightening bolt-nut assemblies 8. When the user is ready to turn the page, he or she retracts moveable shield 9, turns the page as shown in FIG. 5, and then returns the moveable shield 9 to its original state.

On some bathtubs the only free-standing side is on the bather's right, and on some tubs the only free-standing side is on the bathers's left. Accordingly, it is necessary to permit the stationary shield 1 to be mounted on either side of the supporting bar 4. For this purpose, both sides of the supporting bar 4 are equipped with holes that can accept screws 5.

I claim:

1. A waterproof bathtub reading stand, comprising:

(a) a transparent waterproof container consisting of a verticle stationary shield, capable of supporting reading material, and a moveable l-shaped transparent shield, the horizontal section of which slides back and forth through a slot in the stationary shield so as to permit the moveable shield to be retracted to allow access to the reading material and pressed forward against the stationary shield to form the container;

(b) said container being mounted on a bar, said bar being adapted to be placed horizontally across a bathtub and affixed to one side of the bathtub by means of a clamp consisting of two small bars that slide along a slot in the horizontal bar and are thereby adjusted to the width of the side of the bathtub and thereafter fixed in position by means of bolt-nut assemblies.

2. A waterproof bathtub reading stand, as described in claim 1, wherein a semi-circular aperture is provided in the horizontal section of the moveable shield, through which there protrude clip assemblies that are attached to, and are used to turn, pages of the reading material, each clip assembly consisting of a clip opened by means of a tab and closed by means of a spring.

3. A waterproof bathtub reading stand, as described in claim 1, wherein elastic straps are secured to the stationary shield by means of screws for the purpose of holding the reading material in place.

* * * * *